United States Patent [19]

Courier de Méré

[11] 4,147,499

[45] Apr. 3, 1979

[54] VOLTAGE BOOSTING TRANSFORMER AND AN ELECTRONIC IGNITION GAS LIGHTER USING SUCH A TRANSFORMER

[75] Inventor: Henri E. F. M. Courier de Méré, Paris, France

[73] Assignee: BICOSA Societe de Recherches, France

[21] Appl. No.: 823,019

[22] Filed: Aug. 8, 1977

[30] Foreign Application Priority Data

Aug. 23, 1976 [FR] France ..... 76 25504

[51] Int. Cl.[2] ..... F23Q 7/12

[52] U.S. Cl. ..... 431/255

[58] Field of Search ..... 431/130, 131, 255

[56] References Cited

U.S. PATENT DOCUMENTS

| | | | |
|---|---|---|---|
| 3,427,117 | 2/1969 | Dieterle | 431/255 |
| 3,442,598 | 5/1969 | Halm | 431/255 |
| 3,458,765 | 7/1969 | Schindler | 431/255 |

*Primary Examiner*—Carroll B. Dority, Jr.

*Attorney, Agent, or Firm*—Robert E. Burns; Emmanuel J. Lobato; Bruce L. Adams

[57] ABSTRACT

An electric ignition lighter of the type having a fuel gas reservoir and a nozzle for releasing the gas includes a pair of spaced-apart electrodes defining therebetween a spark-gap. One of the electrodes comprises the nozzle and the other of the electrodes comprises an elongated electrically conductive element the lower portion of which comprises the magnetic core of a transformer and has wound therearound the primary and secondary transformer windings. One terminal of the secondary winding is electrically connected to the nozzle which forms one electrode and the other terminal of the secondary winding is electrically connected to the elongated conductive element which terminates in the other electrode.

9 Claims, 3 Drawing Figures

VOLTAGE BOOSTING TRANSFORMER AND AN ELECTRONIC IGNITION GAS LIGHTER USING SUCH A TRANSFORMER

BACKGROUND OF THE INVENTION

The invention relates to improvements to a voltage boosting transformer and more particularly to such a transformer whose secondary winding is intended to supply the electrodes of a spark-gap. It also concerns a gas lighter incorporating such a transformer in which the spark-gap is utilized to produce sparks for lighting the fuel gas.

It is an object of the invention to provide a particularly simple and economical transformer and a smoker's lighter incorporating such a transformer.

SUMMARY OF THE INVENTION

The voltage boosting transformer of the invention is characterised in that its magnetic circuit comprises at least a conducting part having an output terminal of the secondary winding in electrical connection with this conducting part. Moreover, the conducting part of the magnetic circuit is integral with an electrode of a spark gap. It will be noticed that with this arrangement, said conducting part constitutes at one and the same time an element of the magnetic circuit of the transformer and an output terminal of the secondary winding of said transformer. This arrangement permits the construction of the circuit comprising such a transformer to be simplified, particularly for the connection of an electrode of the spark-gap.

Preferably, the electrode of the spark-gap forms a single whole with the conducting part of the magnetic circuit. In a particular embodiment of this latter arrangement, the transformer comprises an elongated conducting element, the primary and secondary windings being wound around a first part of this conducting element, the second part of said element forming said spark-gap electrode.

Advantageously, one end of the secondary winding of the transformer is in direct solderless contact with the conducting part of the magnetic circuit.

The conducting part of the magnetic circuit is advantageously formed from a nickel and or chromium based alloy.

The lighter of the invention comprises a transformer of the above-mentioned kind, a spark-gap supplied by this transformer, a gas reservoir and a release nozzle for the gas. It is characterised in that the release nozzle constitutes the second electrode of the spark-gap; this nozzle is in electrical connection with the second output terminal of the secondary winding of said transformer, preferably through earth or ground. It is then advantageous for said transformer to be of the above-mentioned kind with an elongated conducting element comprising first and second parts, the primary and secondary windings being wound around the first part; in this case, the end of the second part of the conducting element is located opposite said gas release nozzle.

DESCRIPTION OF A PREFERRED EMBODIMENT

Other objects, aspects and advantages of the invention will become more apparent from a reading of the following detailed description of one of its embodiments, this description being made with reference to the accompanying drawings in which.

Figure 1:
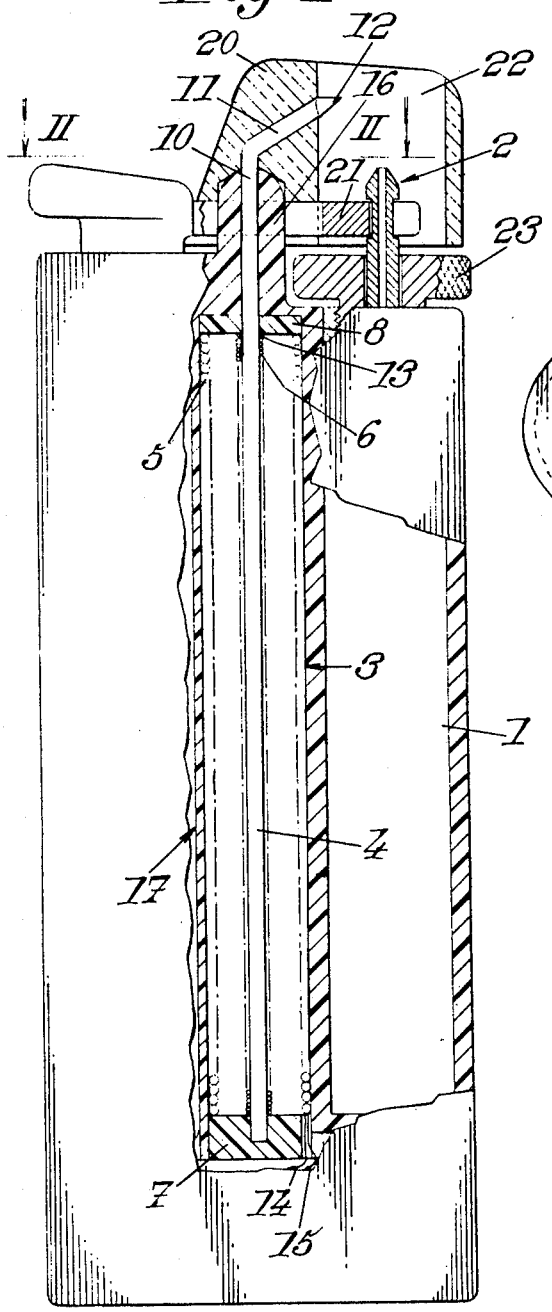
FIG. 1 shows schematically and partially cut away, a lighter and a transformer according to the invention.
Figure 2:
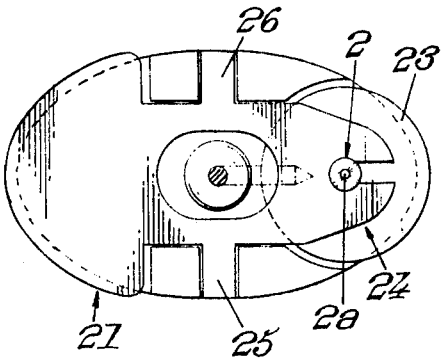
FIG. 2 illustrates a sectional view taken along line II—II of FIG. 1.
Figure 3:
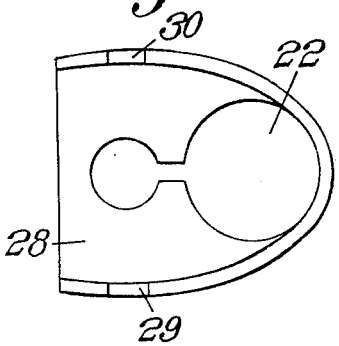
FIG. 3 shows a bottom view of an insulating member for the lighter shown in FIG. 1.

The lighter which will now be described with reference to FIGS. 1 to 3 is a lighter which comprises a gas reservoir 1, a nozzle 2 for the release of the fuel gas contained in the reservoir 1 and a spark-gap comprising two electrodes which are fed by a supply circuit, for example of the kind described in German patent application N 2 303 168, which comprises an output transformer 3 of the voltage booster type to the terminals of the secondary winding of which are connected the electrodes of the spark-gap.

In accordance with the invention, the booster transformer 3 comprises an elongated conducting element 4 which, in the example, has a circular section. This conducting element is formed from a nickel alloy so as to be able to constitute at one and the same time the magnetic circuit of the transformer 3 and an output terminal of the secondary winding of the transformer.

In the example, the primary 5 and secondary 6 windings of the transformer are located about the major part of the length of element 4. This part occupies a substantial lengthwise part of the total length of the lighter and the total height of windings 5, 6 corresponds substantially to the height of the gas reservoir 1.

Windings 5 and 6 are disposed, in the longitudinal direction of the element 4, between two insulating plates comprising a lower plate 7 and an upper plate 8.

The electric supply for the primary winding 5 is provided by two wires 14 and 15 passing through the insulating plate 7.

Conducting element 4 extends beyond windings 5 and 6 and above the plate 8 forms a second part 10 having a bent end 11 finishing in a tapered or pointed part 12 opposite the nozzle 2.

The last turn 13 of the secondary winding 6 is in direct contact, without soldering, with the elongated conducting element 4. This electrical contact provides the electrical connection of one of the output terminals of the secondary winding to the electrode 10–20 of the spark-gap. The connection of the second output terminal (not shown) of the secondary winding 6 with the nozzle 2 is provided through earth or ground.

It is important to note that the overall diameter of the transformer 3 is small in relation to that of the lighter as a whole. In fact, the diameter of the wires forming windings 5 and 6 may be particularly reduced; thus in a particular embodiment the diameter of the insulated wire forming the winding 6 is 22 microns. With this arrangement the space occupied by the transformer 3 corresponds to that of flint shafts provided in disposable lighters of known type.

Since the conducting element 4 is, in operation, brought to a high value potential in relation to earth, it is necessary for all the parts of this element 4 to be well insulated from earth, so as to avoid the occurrence of undesirable sparks. For this purpose, the upper part 10 of the conducting element 4 is surrounded, over a part of its length, by an insulating member 16 formed, by moulding, of a plastic material. This member 16 forms part of an insulative frame 17, also formed by moulding. This frame surrounds and supports the transformer 3. It will be noted here that the gas reservoir 1 has substantially the shape of a crown surrounding the transformer 3 and its frame.

The upper part of the insulating member 16 is covered by an insulating cap 20 which mates with the upper part of the member 16 as well as the end of said part 10 of conducting element 4 which is not surrounded by the member 16.

Cap 20 covers also a part of an actuating member 21, as can be seen in FIGS. 2 and 3. This member 21 is provided particularly for controlling the vertical movement of the nozzle 2 in order to ensure the release of gas when a flame is desired.

Insulating cap 20 also has a cylindrical aperture 22 surrounding the nozzle 2 and located above the nozzle. Tip 12 of end 10 of the conducting element emerges inside the cylindrical aperture 22. Thus the aperture 22 constitutes an outlet chimney above which the flame appears.

Cap 20 is formed from an insulating material capable of supporting a relatively high temperature for it is located adjacent the flame.

Finally, in referring again to FIG. 1, above the nozzle 2 and cap 20 there is provided a small wheel 23 for adjusting the gas output flow.

As shown in FIG. 2, the lighter of the invention has, in section, a generally elliptical shape.

Actuating member 21 has at its one end cooperating with the nozzle 2 fork-shape part 24 which surrounds the part of the nozzle 2 which is below the nozzle tip 2*a*. Member 21 comprises furthermore two lateral spindles 25 and 26, in extension of each other, resting in corresponding notches provided in the outer frame 27 of the lighter. Of course, cap 20 comprises at its lower part a recessed portion 28 to allow actuating member 21 to pass, as well as notches 29 and 30 on its lower side wall and which are dimensioned to surround and accommodate the spindles 25 and 26.

In order to produce a flame with the lighter of the invention, the gas release is controlled by means of the member 21 and the electric supply circuit (not shown) for conductors 14 and 15 is closed. Thus, conducting element 4 is brought to a high voltage in relation to earth and a spark appears between the end 12 of the element 4 and the nozzle 2 which is connected so as to be at earth potential. Thus the fuel gas can be lit.

It will be noticed that it is not indispensable to take particular precautions for establishing the contact between the last turn 13 of the secondary winding 6 of transformer 3 and the conducting element 4. In fact, between the last turn 13 and the conductor 4, the electrical current only passes for brief periods of time and, with the high voltage used, it does not matter if the contact is not quite complete.

In order to improve the efficiency of the transformer 3, the conducting element 4 can, as a variation, be formed from a metal; in this case, it is advantageous to coat with nickel the parts 10–12 of the electrode so as to improve the conducting properties thereof.

The transformer and the lighter of the invention present numerous advantages. Particularly, they are of a particularly simple and economical construction.

Although the transformer of the invention finds its preferred application in the construction of a lighting circuit for gas lighters, this transformer may be used for other purposes.

As is evident, and as it results moreover already from what has gone before, the invention is in no way limited to that of its modes of application, and those of the embodiments of its different parts, which have been more particularly considered; it covers, on the contrary, all variations thereof.

I claim:

1. A lighter comprising: a fuel gas reservoir; a gas release nozzle for the release of the fuel gas; means for lighting the fuel gas comprising two spaced electrodes defining therebetween a spark-gap; and means for supplying an electric potential across the spark-gap comprising an output transformer having a magnetic circuit, a primary winding and a secondary winding, said secondary winding being intended to supply an electric potential to said electrodes of the spark-gap, said magnetic circuit of said transformer comprising at least one electrically conducting part which forms an integral one-piece structure with one of said electrodes, said secondary winding having an output terminal in electrical connection with said one conducting part, an elongated conducting element having said primary and secondary windings of said transformer wound around a first part of said conducting element and a second part of said conducting element comprising said one conducting part which carries said one electrode of the spark-gap, and wherein the other electrode of said spark-gap comprises said gas release nozzle, said nozzle and a terminal of the secondary winding of said transformer being, in operation, brought to the same potential.

2. A lighter according to claim 1, further comprising an insulating member surrounding said one electrode of said spark-gap.

3. A lighter according to claim 1, wherein said conducting part of the magnetic circuit is formed from an alloy of at least one metal of the group constituted by nickel and chromium.

4. A lighter according to claim 1, wherein at least one turn of the secondary winding is in solderless contact with said conducting part of the magnetic circuit.

5. A lighter according to claim 1, wherein the first part of the conducting element and the primary and secondary windings occupy a substantial fraction of the total length of said lighter, the second part of the conducting element comprising a bent end which finishes in a tip opposite said gas release nozzle.

6. A lighter according to claim 5, wherein the gas reservoir is located around the unit formed by said first part of the conducting element and the primary and secondary windings.

7. In an electric ignition lighter of the type having a fuel gas reservoir and a nozzle for releasing the gas to be ignited: two spaced-apart electrodes defining therebetween a spark-gap, one of said electrodes comprising said nozzle and the other of said electrodes comprising an elongated electrically conductive element; and means for supplying an electric potential to said two electrodes to initiate a spark in said spark-gap comprising a transformer having a magnetic circuit which includes a major lengthwise part of said elongated conductive element, and primary and secondary windings wound around said major lengthwise part of said elongated conductive element, and means for electrically connecting one terminal of said secondary winding to said nozzle which comprises one of said two electrodes and electrically connecting the other terminal of said secondary winding to said elongated conductive element which comprises the other of said two electrodes.

8. A lighter according to claim 7; including means comprising electrical insulative material surrounding that part of said electrically conductive element which extends outside said transformer except for the end tip thereof which is spaced from said nozzle.

9. A lighter according to claim 7; wherein said means electrically connecting the other terminal of said secondary winding to said elongated conductive element comprises at least the last turn of said secondary winding being in solderless contact with said conductive element.

* * * * *